US010876780B1

(12) United States Patent
Tarantino et al.

(10) Patent No.: US 10,876,780 B1
(45) Date of Patent: Dec. 29, 2020

(54) COOLER BEVERAGE INSERTS

(71) Applicants: Michael Nicholas Tarantino, Calhoun, LA (US); Ashley Laine Tarantino, Calhoun, LA (US)

(72) Inventors: Michael Nicholas Tarantino, Calhoun, LA (US); Ashley Laine Tarantino, Calhoun, LA (US)

( * ) Notice: Subject to any disclaimer, the term of this patent is extended or adjusted under 35 U.S.C. 154(b) by 150 days.

(21) Appl. No.: 15/924,856

(22) Filed: Mar. 19, 2018

(51) Int. Cl.
*F25D 3/08* (2006.01)
*F25D 31/00* (2006.01)
*B65D 81/18* (2006.01)

(52) U.S. Cl.
CPC ..... *F25D 3/08* (2013.01); *F25D 31/007* (2013.01); *B65D 81/18* (2013.01); *F25D 2303/08222* (2013.01); *F25D 2331/805* (2013.01)

(58) Field of Classification Search
CPC . F25D 3/08; F25D 31/007; F25D 3/00; F25D 2331/804; F25D 2303/08222; F25D 2331/805; F25D 2303/0841; F25D 2331/809; F25D 2303/084; F25D 2303/082; F25D 2303/0831; A45C 11/20; A47J 41/0044; B65D 81/03; B65D 81/18; B65D 81/3883; B65D 81/3886; A63B 2225/682
See application file for complete search history.

(56) References Cited

U.S. PATENT DOCUMENTS 3,401,535 A * 9/1968 Palmer ..... F25D 3/00 62/457.5
3,423,061 A * 1/1969 Pietrzak ..... A23G 9/26 249/92
4,280,336 A * 7/1981 Taylor ..... A45C 11/20 206/541
4,441,336 A 4/1984 Cannon
4,554,978 A 11/1985 D'Amour et al.
4,741,176 A 5/1988 Johnson et al.
RE32,740 E 8/1988 Steffes
4,916,923 A * 4/1990 Adams ..... A45C 11/20 62/457.1
5,758,513 A * 6/1998 Smith ..... A45C 11/20 62/457.5
5,901,571 A * 5/1999 Whaley ..... F25D 3/08 62/457.5

(Continued)

*Primary Examiner* — Frantz F Jules
*Assistant Examiner* — Martha Tadesse
(74) *Attorney, Agent, or Firm* — R. Keith Harrison

(57) ABSTRACT

Cooler beverage inserts may include an insert container having an insertion surface and a container retrieval surface opposite the insertion surface. A container interior may extend between the insertion surface and the container retrieval surface. The container interior may be configured to contain a cooling medium. At least one receptacle interior may extend from the insertion surface through the container interior to the container retrieval surface and open to the insertion surface and the container retrieval surface. The at least one receptacle interior may be sized and configured to accommodate a plurality of beverage containers. The at least one receptacle interior may have a uniform width or diameter from the insertion surface to the container retrieval surface. Accordingly, the plurality of beverage containers may be sequentially removable from the at least one receptacle interior without removal of the insert container from the cooler.

14 Claims, 6 Drawing Sheets

(56) References Cited

U.S. PATENT DOCUMENTS

| | | | | |
|---|---|---|---|---|
| 6,216,487 | B1 * | 4/2001 | Gano, III | B65D 77/0486 62/457.5 |
| 6,446,461 | B1 * | 9/2002 | Williams, Jr. | A45C 11/20 220/592.16 |
| 7,100,397 | B1 * | 9/2006 | Gratteau | F25D 3/08 62/457.5 |
| 8,516,849 | B2 | 8/2013 | Mooijer et al. | |
| 9,423,168 | B1 | 8/2016 | Rosso | |
| 2005/0087538 | A1 * | 4/2005 | Wolfe | A47J 41/0044 220/592.16 |
| 2007/0186580 | A1 * | 8/2007 | Kaplan | A23L 3/36 62/457.5 |
| 2015/0192340 | A1 * | 7/2015 | Andrews | F25D 3/08 62/457.5 |

* cited by examiner

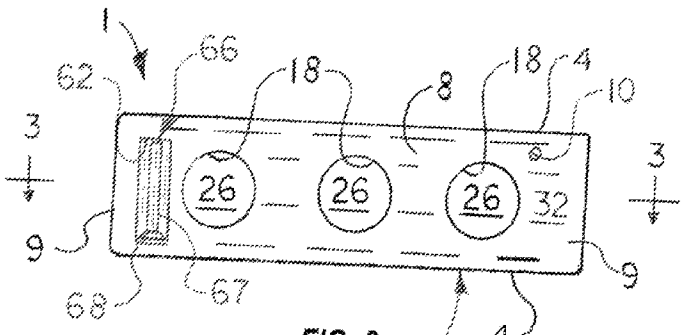
FIG. 1
FIG. 2
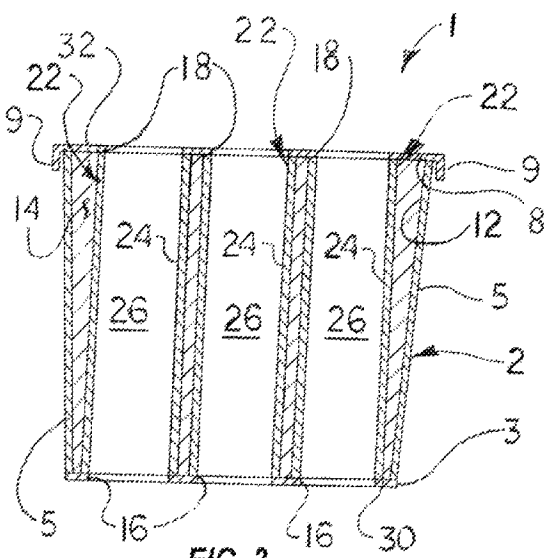
FIG. 3
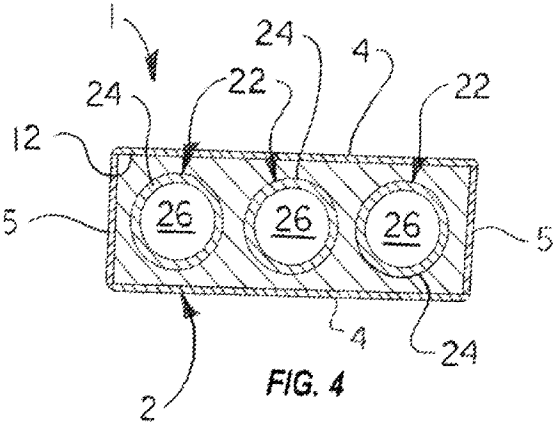
FIG. 4

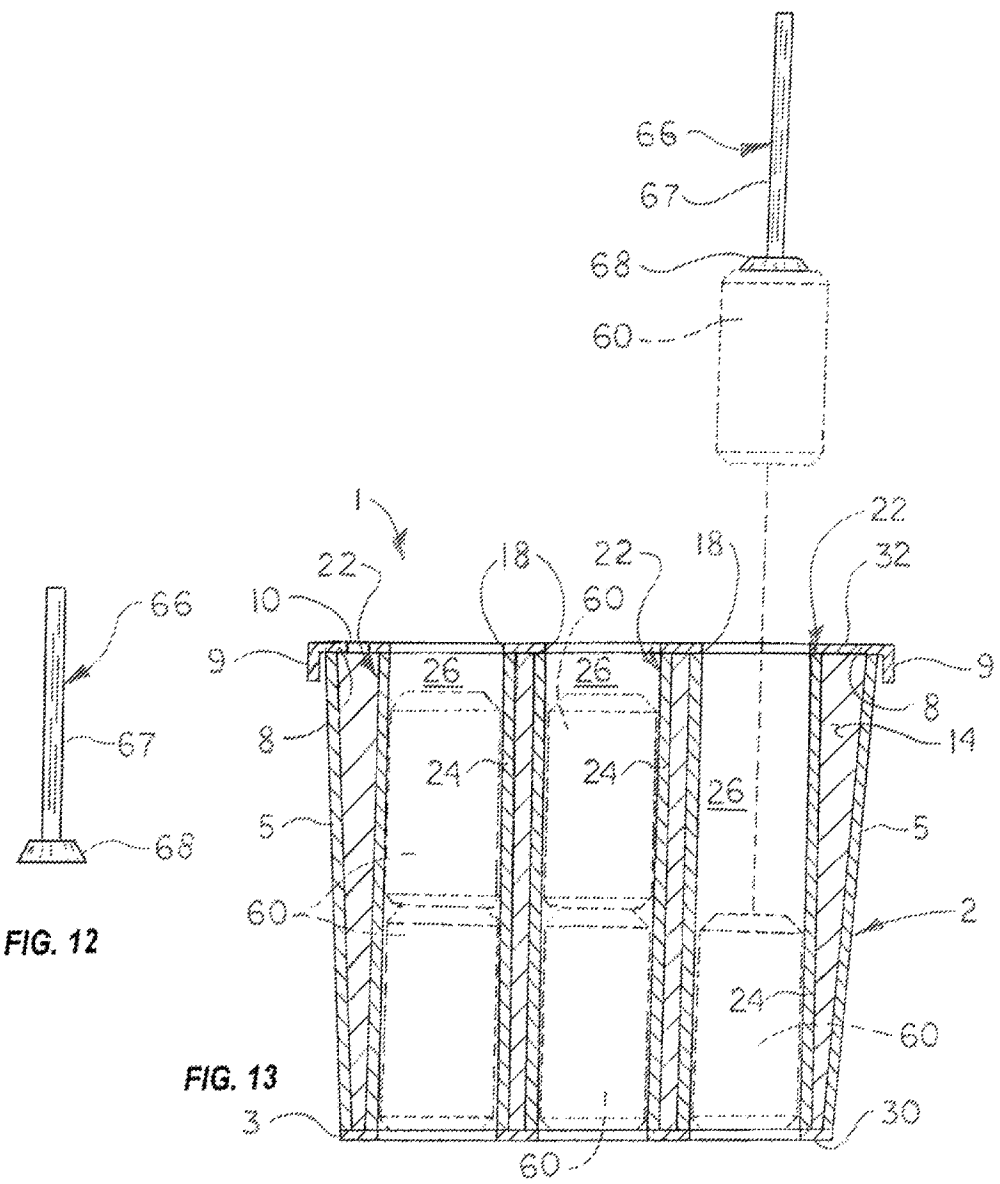
FIG. 12
FIG. 13
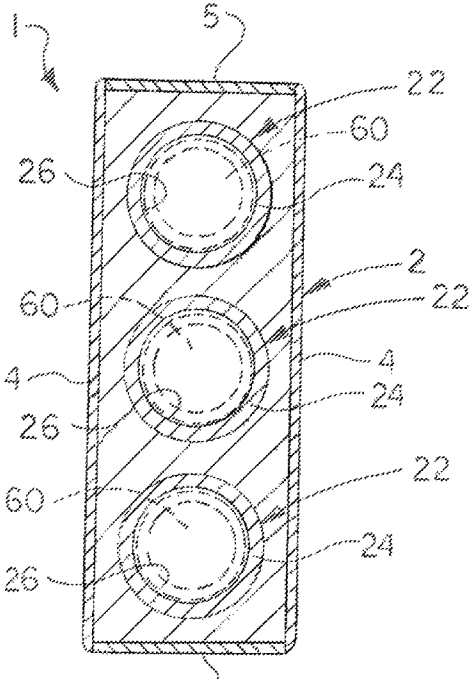
FIG. 11

COOLER BEVERAGE INSERTS

FIELD

Illustrative embodiments of the disclosure generally relate to coolers. More particularly, illustrative embodiments of the disclosure relate to cooler beverage inserts which can be placed in a cooler and into which can be inserted one or multiple beverage containers to maintain the beverage containers in a cold condition until consumption of a beverage in the containers.

SUMMARY

Illustrative embodiments of the disclosure are generally directed to cooler beverage inserts for placement into a cooler and containing a plurality of beverage containers to maintain the beverage containers in a cold condition until consumption of a beverage in the containers. An illustrative embodiment of the cooler beverage inserts includes an insert container having an insertion surface and a container retrieval surface opposite the insertion surface. A container interior may extend between the insertion surface and the container retrieval surface. The container interior may be configured to contain a cooling medium. At least one receptacle interior may extend from the insertion surface through the container interior to the container retrieval surface and open to the insertion surface and the container retrieval surface. The at least one receptacle interior may be sized and configured to accommodate a plurality of beverage containers. The at least one receptacle interior may have a uniform width or diameter from the insertion surface to the container retrieval surface. Accordingly, the plurality of beverage containers may be sequentially removable from the at least one receptacle interior without removal of the insert container from the cooler.

BRIEF DESCRIPTION OF TIE DRAWINGS

Illustrative embodiments of the disclosure will now be described, by way of example, with reference to the accompanying drawings, in which:

FIG. 1 is a perspective view of an illustrative embodiment of the cooler beverage inserts;

FIG. 2 is a top view of the illustrative cooler beverage insert;

FIG. 3 is a sectional view, taken along section lines 3-3 in FIG. 2, of the illustrative cooler beverage insert;

FIG. 4 is a sectional view, taken along section lines 4-4 in FIG. 1, of the illustrative cooler beverage insert;

FIG. 11 is a cross-sectional view, taken along section lines 4-4 in FIG. 1, of the illustrative cooler beverage insert with multiple beverage containers (illustrated in phantom) placed in the cooler beverage insert;

FIG. 12 is a side view of a typical beverage container retrieval device suitable for removing beverage containers from the cooler beverage insert as the cooler beverage insert typically remains in place in the cooler;

FIG. 13 is a sectional view, taken along section lines 3-3 in FIG. 2, of the illustrative cooler beverage insert, with multiple beverage containers (illustrated in phantom) in the cooler beverage insert, more particularly illustrating typical removal of a beverage container from the cooler beverage insert using the beverage container retrieval device;

DETAILED DESCRIPTION

Figure 6:
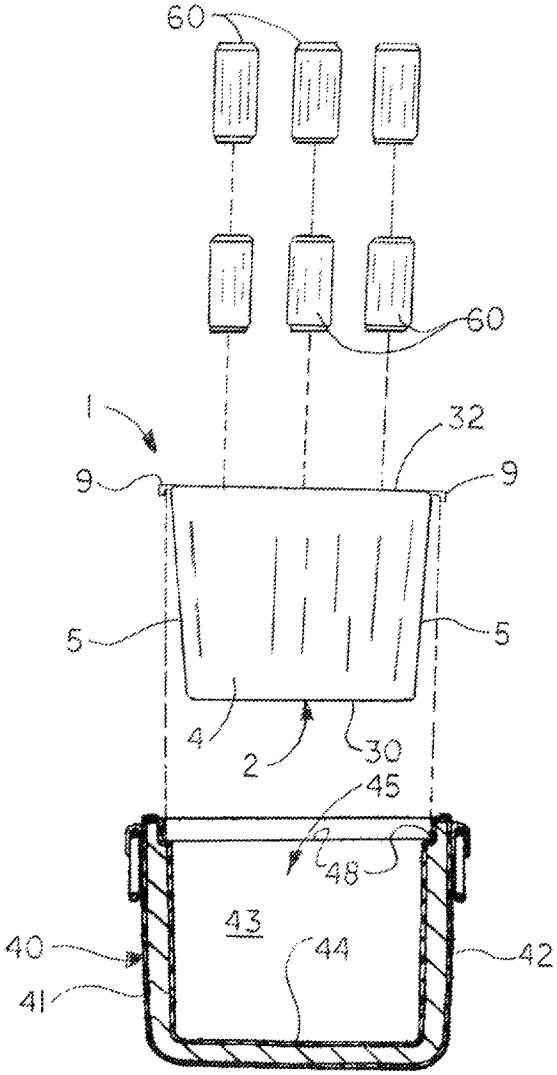
FIG. 6 is an exploded view illustrating typical placement of the illustrative cooler beverage insert into the cooler (shown in cross-section) and placement of multiple beverage containers into the cooler beverage insert.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Referring initially to FIGS. 1-13 of the drawings, an illustrative embodiment of the cooler beverage inserts is generally indicated by reference numeral 1. As illustrated in FIGS. 5-13 and will be hereinafter described, the cooler beverage insert 1 may facilitate placement of multiple beverage containers 60 in a cooler 40 to maintain the beverage containers 60 in a cold condition until consumption of a liquid beverage (not illustrated) in the beverage containers 60. In typical use, the cooler beverage insert 1 may initially be placed in a refrigerator or freezer (not illustrated) for a period of time to reduce the temperature of the cooler beverage insert 1. The cooler beverage insert 1 may then be placed into the cooler 40 and the beverage containers 60 placed into the cooler beverage insert 1. The beverage containers 60 may be completely contained within the cooler beverage insert 1 to maximize the cooling efficiency of the cooler beverage insert 1. The beverage containers 60 may be individually removed from the cooler beverage insert 1 for consumption of the beverage without the need to first remove the cooler beverage insert 1 from the cooler 40. Moreover, the emptied cooler beverage insert 1 may remain in the cooler interior 45 to maintain additional food and/or beverage (not illustrated) in a cold condition until consumption of the food and/or beverage.

Figure 5:
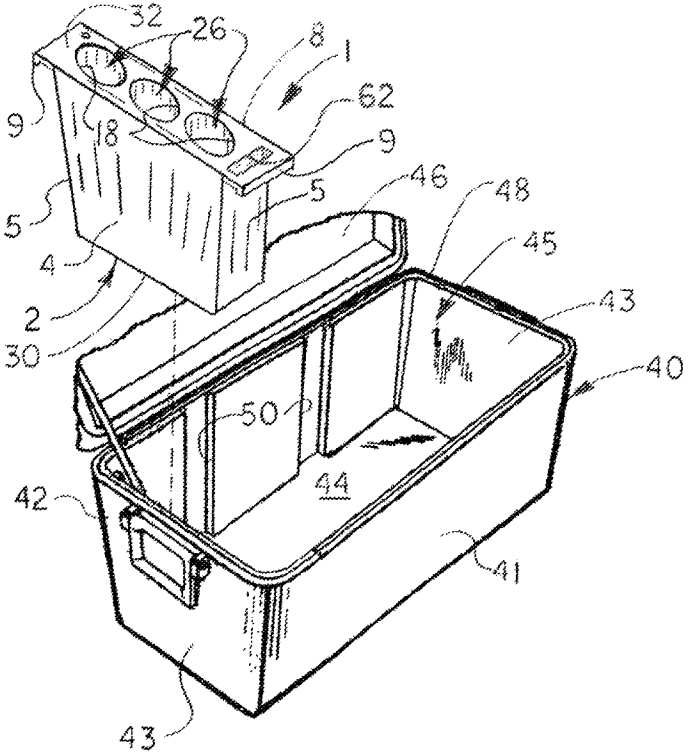
FIG. 5 is an exploded perspective view illustrating typical placement of the illustrative cooler beverage insert into a cooler (partially in section) in typical application of the cooler beverage inserts.
Figure 9:
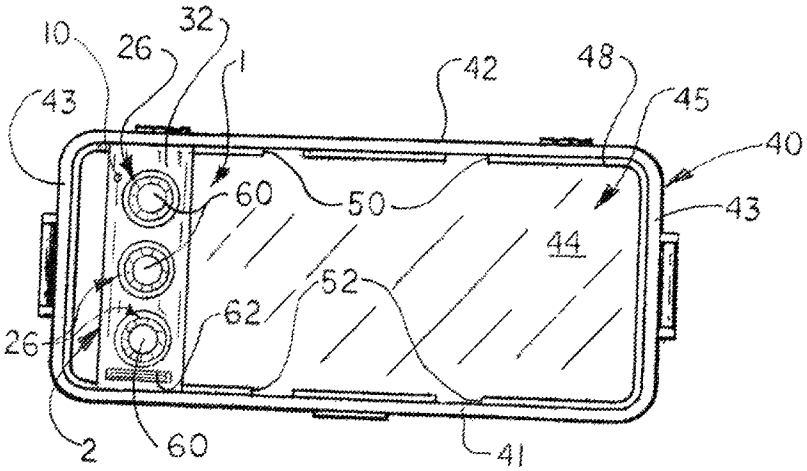
FIG. 9 is a top view illustrating the illustrative cooler beverage insert placed into the cooler and multiple beverage containers placed in the cooler beverage insert.
Figure 15:
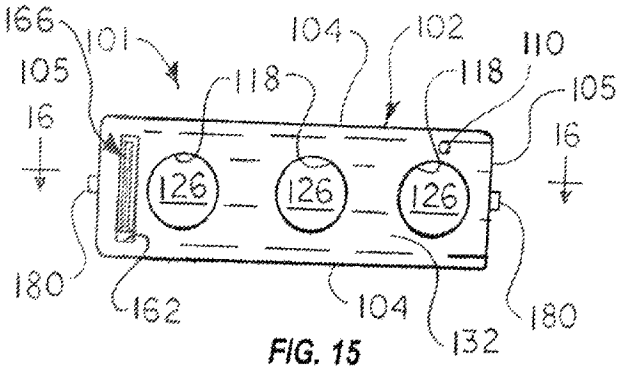
FIG. 15 is a top view of the illustrative cooler beverage insert illustrated in FIG. 14.
Figure 17:
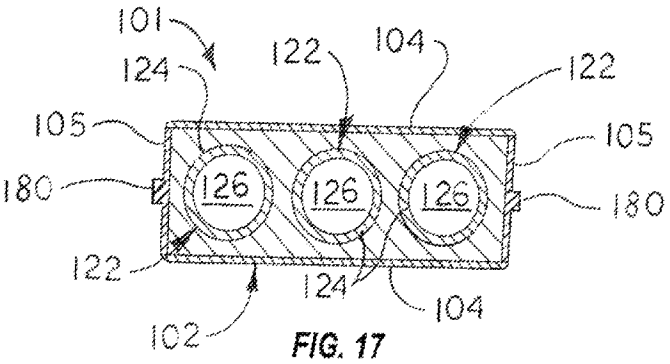
FIG. 17 is a horizontal sectional view, taken along section lines 17-17 in FIG. 14, of the illustrative cooler beverage insert.
Figure 14:
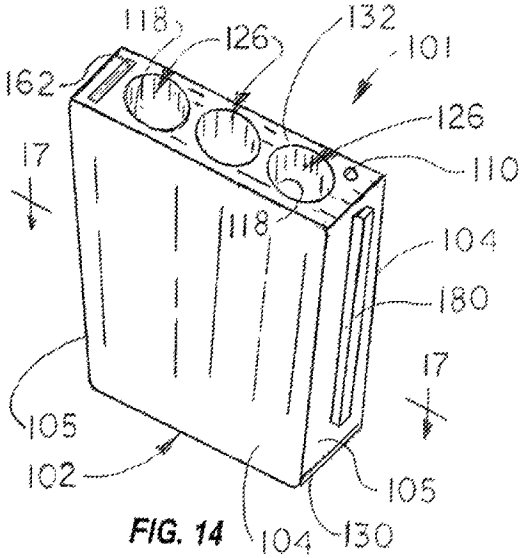
FIG. 14 is a perspective view of an alternative illustrative embodiment of the cooler beverage inserts.
Figure 16:
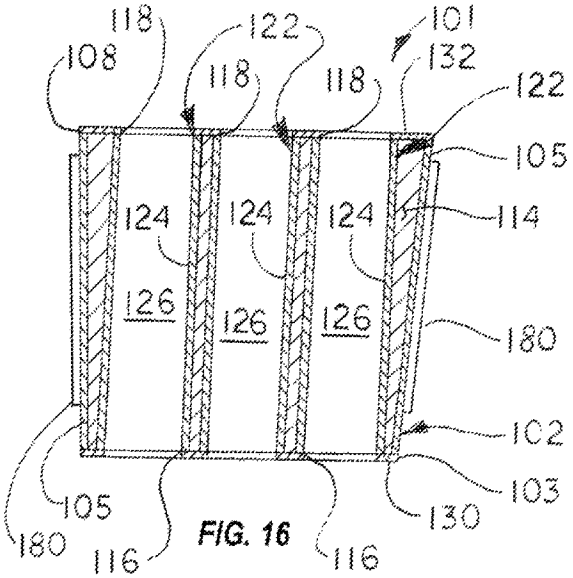
FIG. 16 is a vertical sectional view, taken along section lines 16-16 in FIG. 15, of the illustrative cooler beverage insert.

As illustrated in FIG. 5, the cooler 40 may be standard or conventional in design with a front cooler panel 41, a rear cooler panel 42, a pair of side cooler panels 43, a bottom cooler panel 44 and a cooler interior 45. A cooler lid 46 may be hinged to the rear cooler panel 42. A recessed cooler shoulder 48 may extend along the upper perimeter of the front cooler panel 41, the rear cooler panel 42 and the side cooler panels 43. As illustrated in FIG. 9, a pair of rear panel grooves 50 and a registering pair of front panel grooves 52 may be provided in the rear cooler panel 42 and the front cooler panel 41, respectively, in facing relationship to the cooler interior 45. The rear panel grooves 50 and the front panel grooves 52 may extend from the cooler shoulder 48 to the bottom cooler panel 44 of the cooler 40.

The cooler beverage insert 1 may include an insert container 2. The insert container 2 may be fabricated of plastic, composite material and/or other heat-conductive or transferrable material which is suitable for the purpose. In some embodiments, the insert container 2 may have a unitary construction and may be fabricated using molding, casting, machining, heat-sealing, welding, soldering and/or other fabrication techniques known by those skilled in the art. The insert container 2 may have an insertion surface 30 and a container retrieval surface 32 opposite the insertion surface 30. As illustrated in FIGS. 3 and 4, a container interior 12 may extend between the insertion surface 30 and the container retrieval surface 32. The container interior 12 may be configured to contain a cooling medium 14. The cooling medium 14 may include water and/or other liquid, solid and/or semi-solid, coolable refrigerant material which is known by those skilled in the art. The insert container 2 may have a width which substantially corresponds to or is slightly less than the distance between the front cooler panel 41 and the rear cooler panel 42 of the cooler 40. The insert container 2 may have a height which substantially corresponds to or is slightly less than the distance between the cooler shoulder 48 and the bottom cooler panel 44 of the cooler 40.

As further illustrated in FIG. 3, at least one receptacle interior 26 may extend from the insertion surface 30 through the container interior 12 to the container retrieval surface 32. The receptacle interior 26 may open to the insertion surface 30 and the container retrieval surface 32. As illustrated in FIG. 13, each receptacle interior 26 may be sized and configured to accommodate a plurality of beverage containers 60 in stacked relationship to each other. Each receptacle interior 26 may have a uniform width or diameter from the insertion surface 30 to the container retrieval surface 32. Accordingly, the plurality of beverage containers 60 may be sequentially removable from each receptacle interior 26 without removal of the insert container 2 from the cooler 40. The insert container 2, emptied of the beverage containers 60, may remain in place in the cooler interior 45 to maintain other foods and/or beverages in a cold condition until consumption.

As further illustrated in FIG. 3, in some embodiments, the insert container 2 may include a bottom container panel 3 and a top container panel 8 opposite the bottom container panel 3. Accordingly, the insertion surface 30 may be on the bottom container panel 3 and the container retrieval surface 32 may be on the top container panel 8. A pair of spaced-apart side container panels 4 and a pair of spaced-apart end container panels 5 may extend from the bottom container panel 3 to the top container panel 8. In some embodiments, the end container panels 5 may taper inwardly from the top container panel 8 to the bottom container panel 3. The tapered end container panels 5 may correspond to the taper of the front cooler panel 41 and the rear cooler panel 42 from the cooler shoulder 48 to the bottom cooler panel 44.

Figure 8:
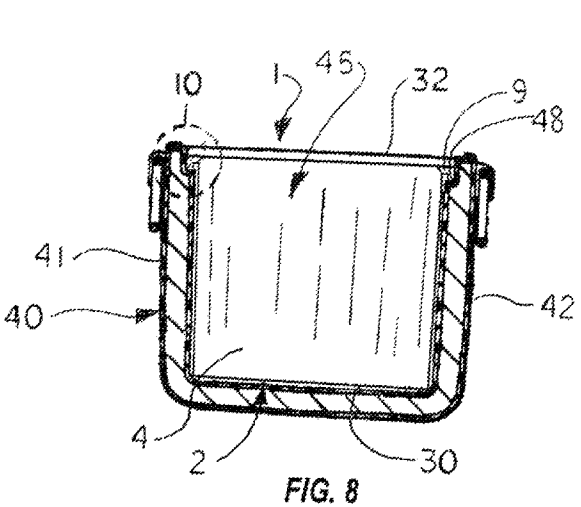
FIG. 8 is a front view of the illustrative cooler beverage insert placed into the cooler (shown in cross-section)
Figure 10:
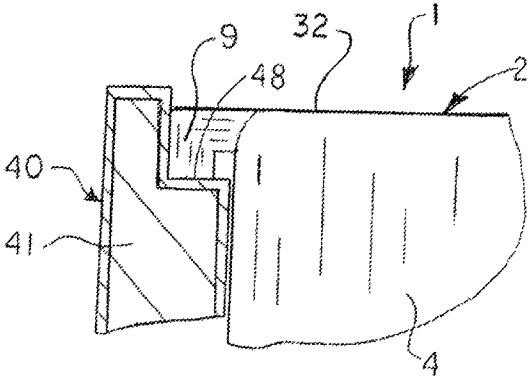
FIG. 10 is an enlarged sectional view, taken along section line 10 in FIG. 8, more particularly illustrating typical engagement of an insert support flange on the cooler beverage insert with a cooler shoulder in the cooler.

In some embodiments, a pair of insert support flanges 9 may extend from the top container panel 8 beyond the respective pair of end container panels 5. As illustrated in FIGS. 8 and 10, the insert support flanges 9 may be suitably sized and configured to engage and rest upon the cooler shoulder 48 in the cooler 40 for purposes which will be hereinafter described. In some embodiments, a fill opening 10 may extend through the top container panel 8 to facilitate placement of the cooling medium 14 in the container interior 12. In other embodiments, the cooling medium 14 may be placed and sealed in the container interior 12 during fabrication of the cooler beverage insert 1 according to the knowledge of those skilled in the art.

As further illustrated in FIG. 3, at least one beverage container receptacle 22 may have a receptacle wall 24 which extends from the top container panel 8 through the container interior 12 to the bottom container panel 3. Each receptacle interior 26 may be formed by the receptacle wall 24. In some embodiments, the receptacle wall 24 of each beverage container receptacle 22 may be cylindrical. At least one bottom panel opening 16 may extend through the bottom container panel 3, and at least one top panel opening 18 may extend through the top container panel 8. Each bottom panel opening 16 and each top panel opening 18 may have the same width or diameter as the receptacle interior 26 of each corresponding beverage container receptacle 22. In some embodiments, the respective ends of the receptacle wall 24 of each corresponding beverage container receptacle 22 may protrude through the respective bottom panel opening 16 and top panel opening 18 and terminate at the respective insertion surface 30 and container retrieval surface 32. In other embodiments, the receptacle interior 26 of each corresponding beverage container receptacle 22 may communicate with each corresponding bottom panel opening 16 and top panel opening 18. In some embodiments, each bottom panel opening 16, receptacle interior 26 and top panel opening 18 may have a width or diameter which is slightly larger than that of a standard canned beverage container 60.

As illustrated in FIG. 13, in typical use of the cooler beverage insert 1, which will be hereinafter described, a plurality of beverage containers 60 may be placed in stacked relationship to each other into the receptacle interior 26 of each beverage container receptacle 22. The beverage containers 60 may be completely contained within the corresponding receptacle interior 26 to maximize thermal contact between each beverage container 60 and the interior surface of the receptacle wall 24 and thus, the surface area which is available for thermal transfer between the cooling medium 14 in the container interior 12 and the liquid beverage (not illustrated) in the beverage container 60. Accordingly, the uppermost beverage container 60 in each receptacle interior 26 may be recessed with respect to the container retrieval surface 32, as further illustrated in FIG. 13. Therefore, as illustrated in FIGS. 12 and 13, in some embodiments, a beverage container retrieval device 66 may be used to individually and successively remove the beverage containers 60 from each receptacle interior 26 without having to first remove the insert container 2 from the cooler interior 45 of the cooler 40. The beverage container retrieval device 66 may include a device handle 67. A beverage container engaging element 68 may be provided on the device handle 67. The beverage container engaging element 68 may include any type of device, element or component which is configured to engage and secure or hold the beverage container 60 to facilitate lifting or removal of the beverage container 60 from the receptacle interior 26. In some embodiments, the beverage container engaging element 68 may include a suction cup. In other embodiments, the beverage container engaging element 68 may include a strap or other device, element or component which engages and facilitates lifting of the beverage container 60 from the receptacle interior 26.

In some embodiments, the beverage container retrieval device 66 may be detachably attached to or removable from the insert container 2 according to the knowledge of those skilled in the art. Accordingly, in some embodiments, an elongated beverage retrieval device cavity 62 may be provided in the container retrieval surface 32 of the insert container 2, as particularly illustrated in FIG. 2. In alternative embodiments, the beverage container retrieval device cavity 62 may be provided in one of the side container panels 4 or elsewhere in the insert container 2. When not in use, the beverage container retrieval device 66 may normally be inserted, seated or contained in the beverage retrieval device cavity 62 for stowage or storage. The beverage container retrieval device 66 may selectively be digitally or manually removed from the beverage retrieval device cavity 62 for use. In other embodiments, a device holder (not illustrated) which is suitable for the purpose may be provided on or in the insert container 2. The device holder may include a flange, bracket, clip, clamp, snaps, hook and loop fasteners and/or other mechanical fastener which is known by those skilled in the art and suitable to detachably attach or removably secure the beverage container retrieval device 66 to or in the insert container 2.

Referring next to FIGS. 5-13 of the drawings, in typical use, at least one cooler beverage insert 1 may facilitate placement of multiple beverage containers 60 in the cooler 40 to maintain the beverage containers 60 in a cold condition until consumption of the liquid beverage (not illustrated) in the beverage containers 60. In some applications, each beverage container 60 may be a standard 8-oz can which contains a liquid beverage (not illustrated) such as a soft drink, beer or fruit juice. In some applications, the cooling medium 14 may be placed in the container interior 12 such as by pouring the cooling medium 14 through the fill opening 10 in the top container panel 8. In other embodiments, the cooling medium 14 may be placed and sealed in the container interior 12 during fabrication of the cooler beverage insert 1 according to the knowledge of those skilled in the art.

Figure 7:
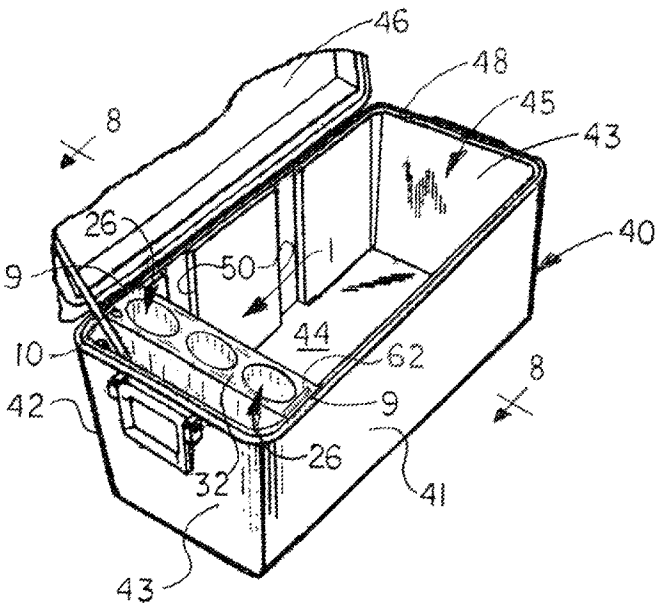
FIG. 7 is a perspective view of the illustrative cooler beverage insert placed into the cooler (illustrated in section)

The cooler beverage insert 1 may initially be placed in a refrigerator or freezer (not illustrated) for a period of time to reduce the temperature of the cooling medium 14. The cooler beverage insert 1 may then be placed into the cooler interior 45 of the cooler 40. Accordingly, as illustrated in FIGS. 5 and 7, the insert container 2 may initially be held over the cooler interior 45 and oriented such that the longitudinal axis of the insert container 2 is transverse to the longitudinal axis of the cooler 40. The insert container 2 may then be lowered in place into the cooler interior 45 until the insert support flanges 9 typically engage and rest upon the portions of the cooler shoulder 48 on the respective front cooler panel 41 and rear cooler panel 42 of the cooler 40, as illustrated in FIGS. 7-10. The beverage containers 60 may then be lowered in place or dropped into the receptacle interiors 26 in the insert container 2.

In some applications, the beverage containers 60 may be inverted before they are placed into the receptacle interior 26. As illustrated in FIG. 13, a plurality of the beverage containers 60 may be placed in stacked relationship to each other in each receptacle interior 26. The uppermost beverage container 60 in each receptacle interior 26 may be recessed with respect to the container retrieval surface 32. This expedient may maximize contact between each beverage container 60 and the interior surface of the receptacle wall 24 and thus, the surface area which is available for thermal transfer between the cooling medium 14 in the container interior 12 and the liquid beverage (not illustrated) in each beverage container 60.

In some applications, a plurality of the insert containers 2 may in like manner be inserted in the cooler interior 45 of the cooler 40 in adjacent, parallel relationship to each other. Additionally or alternatively, ice (not illustrated) may be placed in the remaining portion of the cooler interior 45 and food and/or other beverage (not illustrated) submerged in the ice. The cooler lid 46 may be closed on the cooler 40 for transport of the cooler 40 and its contents to a desired location.

After arrival of the cooler 40 at the desired destination, the cooler lid 46 may be opened to expose the cooler interior 45. The beverage containers 60 may be individually removed from the cooler beverage insert 1 for consumption of the beverage without the need to first remove the cooler beverage insert 1 from the cooler 40. Accordingly, the beverage container retrieval device 66 may be removed from the beverage retrieval device slot 62 or otherwise removed or detached from the insert container 2. The device handle 67 may be grasped and the beverage container engaging element 68 used to individually and sequentially pull or lift the beverage containers 60 from each receptacle interior 26, as illustrated in FIG. 13. The beverage containers 60 may then be opened and the liquid beverage dispensed from the beverage containers 60 for consumption.

After use of the cooler beverage insert 1, the beverage container retrieval device 66 may be replaced in the beverage retrieval device slot 62 or otherwise reattached or secured to or in the insert container 2. The insert container 2 may be lifted from the cooler interior 45 of the cooler 40 as the insert support flanges 9 disengage the cooler shoulder 48. Preparatory to reuse, the insert container 2 may be replaced in the refrigerator or freezer (not illustrated) for a period of time to reduce the temperature of the cooler beverage insert 1. Alternatively, the emptied insert container 2 may remain in place in the cooler interior 45 to maintain additional food and/or beverage (not illustrated) in a cold condition until consumption of the food and/or beverage.

Figure 18:
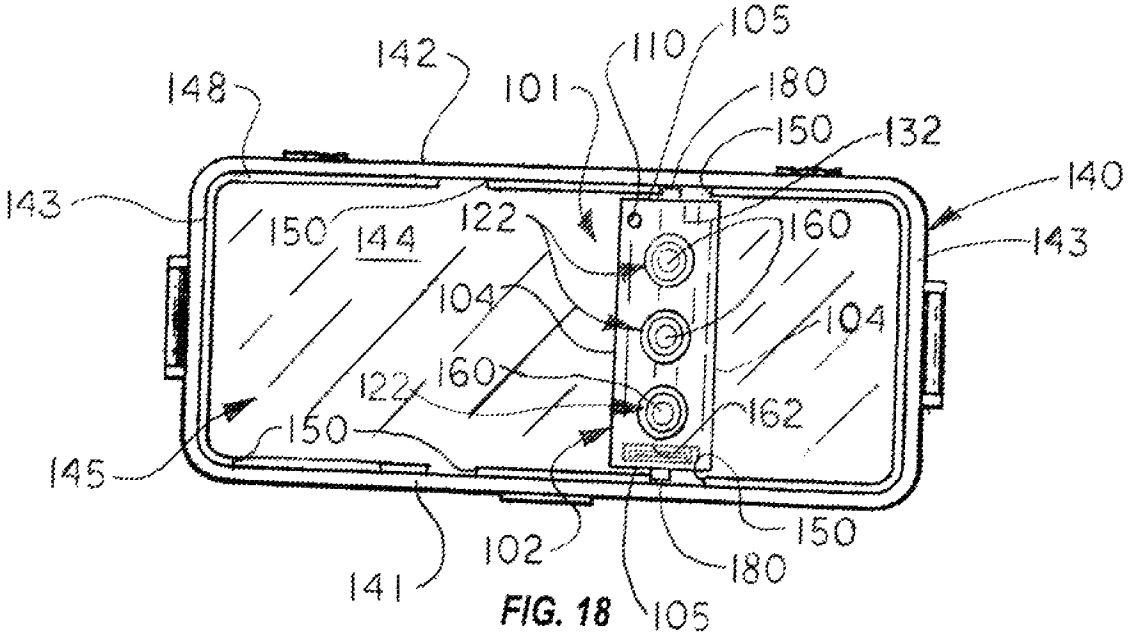
FIG. 18 is a top view illustrating the cooler beverage insert of FIG. 14 placed into the cooler and multiple beverage containers placed in the cooler beverage insert in typical application of the cooler beverage inserts.

Referring next to FIGS. 14-18 of the drawings, an alternative illustrative embodiment of the cooler beverage inserts is generally indicated by reference numeral 101. In the cooler beverage insert 101, elements which are analogous to the respective elements of the cooler beverage insert 1 that was heretofore described with respect to FIGS. 1-13 are designated by the same respective numerals in the 101-199 series in FIGS. 14-18. At least one container rib 180 may extend from each end container panel 105. Each container rib 180 may have a longitudinal axis which is oriented generally from the bottom container panel 103 to the top container panel 108 of the insert container 102. Accordingly, as illustrated in FIG. 18, in placement of the insert container 2 into the cooler interior 145 of the cooler 140, the container ribs 180 may insert into a respective rear panel groove 150 in the rear cooler panel 142 and front panel groove 152 in the front cooler panel 141 of the cooler 140. The container ribs 180 may stabilize the insert container 102 in the cooler interior 145. In some applications, a plurality of the insert containers 102 may be placed in the cooler interior 145 with the container ribs 180 on each insert container 102 inserting into a corresponding pair of the rear panel grooves 150 and the front panel grooves 152. Application of the cooler beverage insert 101 may be as was heretofore described with respect to the cooler beverage insert 1 in FIGS. 1-13.

While the illustrative embodiments of the disclosure have been described above, it will be recognized and understood that various modifications can be made in the disclosure and the appended claims are intended to cover all such modifications which may fall within the spirit and scope of the disclosure.

What is claimed is:

1. A cooler beverage insert for placement into a cooler and containing a plurality of beverage containers, comprising:

an insert container having an insertion surface and a container retrieval surface opposite the insertion surface;

a container interior extending between the insertion surface and the container retrieval surface, the container interior configured to contain a cooling medium;

at least one receptacle interior extending from the insertion surface through the container interior to the container retrieval surface and opening to the insertion surface and the container retrieval surface, the at least one receptacle interior sized and configured to accommodate the plurality of beverage containers;

the at least one receptacle interior having a uniform width or diameter from the insertion surface to the container retrieval surface, whereby the plurality of beverage containers are sequentially removable from the at least one receptacle interior without removal of the insert container from the cooler; and a beverage container retrieval device removably carried by the insert container, the beverage container retrieval device including a device handle and a beverage container engaging element carried by the device handle, the beverage container engaging element configured to detachably engage and facilitate removal of each of the plurality of beverage containers from a corresponding one of the at least one receptacle interior.

2. The cooler beverage insert of claim 1 wherein the insert container comprises a bottom container panel and a top container panel opposite the bottom container panel, and the insertion surface is on the bottom container panel and the container retrieval surface is on the top container panel.

3. The cooler beverage insert of claim 2 further comprising a pair of spaced-apart side container panels and a pair of spaced-apart end container panels extending from the bottom container panel to the top container panel.

4. The cooler beverage insert of claim 3 wherein the pair of spaced-apart end container panels taper from the top container panel to the bottom container panel.

5. The cooler beverage insert of claim 3 further comprising a pair of insert support flanges extending from the top container panel beyond the pair of end container panels, respectively.

6. The cooler beverage insert of claim 3 further comprising at least one beverage container receptacle having a receptacle wall extending from the top container panel through the container interior to the bottom container panel, and wherein the at least one receptacle interior is formed by the receptacle wall.

7. The cooler beverage insert of claim 6 wherein the receptacle wall is cylindrical.

8. The cooler beverage insert of claim 6 further comprising at least one bottom panel opening in the bottom container panel and at least one top panel opening in the top container panel, and wherein the at least one receptacle interior communicates with the at least one bottom panel opening and the at least one top panel opening.

9. The cooler beverage insert of claim 1 wherein the beverage container engaging element comprises a suction cup.

10. A cooler beverage insert for placement into a cooler and containing a plurality of beverage containers, comprising:

an insert container including:

a bottom container panel having an insertion surface;

a plurality of spaced-apart bottom panel openings in the bottom container panel;

a top container panel opposite the bottom container panel, the top container panel having a container retrieval surface;

a plurality of spaced-part top panel openings in the top container panel;

a pair of spaced-apart side container panels extending between the bottom container panel and the top container panel;

a pair of spaced-apart end container panels extending between the bottom container panel and the top container panel;

a container interior formed by and between the bottom container panel, the top container panel, the side container panels and the pair of spaced-apart end container panels, the container interior configured to contain a cooling medium;

a plurality of beverage container receptacles having a plurality of receptacle walls, respectively, extending through the container interior from the bottom container panel to the top container panel;

a plurality of receptacle interiors formed by the plurality of receptacle walls, respectively, the plurality of receptacle interiors communicating with the plurality of spaced-apart bottom panel openings and the plurality of spaced-apart top panel openings, respectively, and each sized and configured to accommodate the plurality of beverage containers; and the plurality of receptacle interiors each having a uniform width or diameter from the insertion surface on the bottom container panel to the container retrieval surface on the top container panel, whereby the plurality of beverage containers are sequentially removable from each of the plurality of receptacle interiors without removal of the insert container from the cooler; and a beverage container retrieval device removably carried by the insert container, the beverage container retrieval device configured to detachably engage and facilitate removal of each of the plurality of beverage containers from a corresponding one of the plurality of receptacle interiors.

11. The cooler beverage insert of claim 10 further comprising a pair of insert support flanges extending from the top container panel beyond the pair of end container panels, respectively.

12. A cooler beverage insert for placement into a cooler and containing a plurality of beverage containers, comprising:

an insert container including:

a bottom container panel having an insertion surface;

a plurality of spaced-apart bottom panel openings in the bottom container panel;

a top container panel opposite the bottom container panel, the top container panel having a container retrieval surface;

a plurality of spaced-part top panel openings in the top container panel;

a pair of spaced-apart side container panels extending between the bottom container panel and the top container panel;

a pair of spaced-apart end container panels extending between the bottom container panel and the top container panel;

a container interior formed by and between the bottom container panel, the top container panel, the side container panels and the pair of spaced-apart end container panels, the container interior configured to contain a cooling medium;

a plurality of beverage container receptacles having a plurality of receptacle walls, respectively, extending through the container interior from the bottom container panel to the top container panel;

a plurality of receptacle interiors formed by the plurality of receptacle walls, respectively, the plurality of receptacle interiors communicating with the plurality of spaced-apart bottom panel openings and the plurality of spaced-apart top panel openings, respectively, and each sized and configured to accommodate the plurality of beverage containers; and the plurality of receptacle interiors each having a uniform width or diameter from the insertion surface on the bottom container panel to the container retrieval surface on the top container panel, whereby the plurality of beverage containers are sequentially removable from each of the plurality of receptacle interiors without removal of the insert container from the cooler; and a beverage container retrieval device removably carried by the insert container, the beverage container retrieval device including:

a device handle; and a beverage container engaging element carried by the device handle, the beverage container engaging element configured to detachably engage and facilitate removal of each of the plurality of beverage containers from a corresponding one of the plurality of receptacle interiors.

13. The cooler beverage insert of claim 12 further comprising a pair of insert support flanges extending from the top container panel beyond the pair of end container panels, respectively.

14. The cooler beverage insert of claim 12 wherein the beverage container engaging element comprises a suction cup.

* * * * *